United States Patent [19]

Redford

[11] 4,127,170

[45] Nov. 28, 1978

[54] VISCOUS OIL RECOVERY METHOD

[75] Inventor: David A. Redford, Fort Saskatchewan, Canada

[73] Assignee: Texaco Exploration Canada Ltd., Canada

[21] Appl. No.: 837,481

[22] Filed: Sep. 28, 1977

[51] Int. Cl.[2] ..... E21B 43/24; E21B 43/26

[52] U.S. Cl. ..... 166/252; 166/271; 166/272

[58] Field of Search ..... 166/252, 263, 272, 303, 166/271

[56] References Cited

U.S. PATENT DOCUMENTS

| | | | |
|---|---|---|---|
| 3,347,313 | 10/1967 | Matthews et al. | 166/272 |
| 3,360,044 | 12/1967 | Lange | 166/272 |
| 3,367,419 | 2/1968 | Van Lookeren | 166/272 X |
| 3,434,541 | 3/1969 | Cook et al. | 166/272 X |
| 3,768,559 | 10/1973 | Allen et al. | 166/272 |
| 3,771,598 | 11/1973 | McBean | 166/272 X |
| 3,847,219 | 11/1974 | Wang et al. | 166/272 X |
| 3,908,762 | 9/1975 | Redford | 166/272 X |
| 4,004,636 | 1/1977 | Brown et al. | 166/272 |
| 4,026,358 | 5/1977 | Allen | 166/272 X |

*Primary Examiner*—Stephen J. Novosad
*Attorney, Agent, or Firm*—Carl G. Ries; Thomas H. Whaley; Jack H. Park

[57] ABSTRACT

Viscous petroleum may be recovered from formations in a process employing steam and a light hydrocarbon, and a cyclical injection-production program comprising repetitive cycles, each comprising three steps. First steam or steam and hydrocarbons are injected and liquids are recovered from the formation without restriction so long as no vapor phase steam production occurs. Next, steam and hydrocarbons are injected and production throttled until the formation pressure at the production well rises to a value between about 60% to 95% of the steam injection pressure, after which fluid production is permitted without restriction and steam and hydrocarbon injection rate is reduced to 50% or less of the original injection rate. The process should be applied to a formation in which adequate communication exists. Suitable hydrocarbons include $C_3$ through $C_{12}$ paraffinic or olefinic hydrocarbons including natural mixture such as naphtha, natural gasoline, etc. Optimum results are obtained if the pressurization and drawdown cycles are initiated shortly after the beginning of the steam-hydrocarbon injection program, and the benefits include substantially increased oil recovery efficiency at all values of steam pore volumes injected, reduced pressure differential, reduced plugging of the communication channel, and production of a preponderance of the viscous petroleum in the form of an oil-in-water emulsion which is easier to handle and to resolve into relatively water-free oil than a water-in-oil emulsion.

16 Claims, 1 Drawing Figure

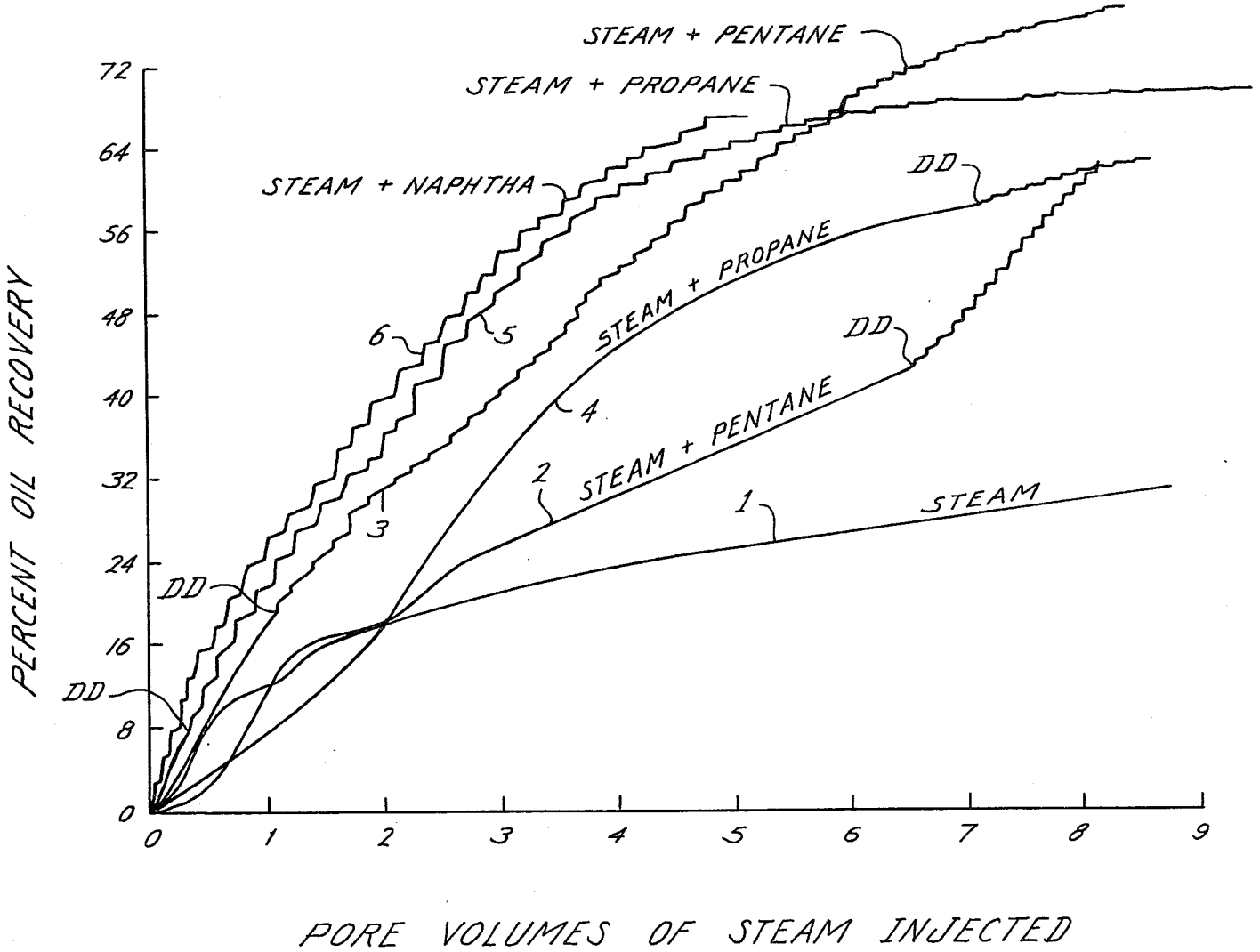
STEAM + PENTANE
STEAM + PROPANE
STEAM + NAPHTHA
STEAM + PROPANE
STEAM + PENTANE
STEAM
DD
DD
DD
DD
1
2
3
4
5
6
PERCENT OIL RECOVERY
72
64
56
48
40
32
24
16
8
0
0
1
2
3
4
5
6
7
8
9
PORE VOLUMES OF STEAM INJECTED

VISCOUS OIL RECOVERY METHOD

BACKGROUND OF THE INVENTION

1. Field of the Invention

This invention pertains to an oil recovery method, and more specifically to a method for recovering viscous oil or viscous petroleum from subterranean deposits thereof including tar sand deposits. Still more specifically, this method employs steam and light hydrocarbons in the $C_3$ to $C_{12}$ range and specific injection-pressurization and frequent drawdown cycles, initiated soon after initiating steam injection.

2. Description of the Prior Art

There are known to exist throughout the world many subterranean petroleum-containing formations from which petroleum cannot be recovered by conventional means because the petroleum contained therein is so viscous that it is essentially immobile at formation temperature and pressure. The most extreme example of viscous petroleum-containing formations are the so called tar sand or oil sand deposits such as those located in the western portion of the United States and northern Alberta, Canada, and in Venezula. Other lesser deposits are known to exist in Europe and Asia.

Tar sands are frequently defined as sand saturated with a highly viscous crude petroleum material not recoverable in its natural state through a well with ordinary production methods. The petroleum contained in tar sand deposits are generally highly bituminous in character. The sand portion is a fine grain quartz sand coated with a layer of water with viscous bituminous petroleum occupying much of the void space around the water-wet sand grains. A small amount of gas is sometimes also present in the void spaces. The sand grains are packed to a void volume of about 35%, which corresponds to about 83% by weight sand. The balance of the material is bituminous petroleum and water. The sum of the bituminous petroleum and water is usually equal to about 17%, with the bituminous petroleum portion thereof varying from about 2% to about 16%.

The sand grains are tightly packed in the formation in tar sand deposits but are generally not consolidated. The API gravity of the bituminous petroleum ranges from about 5 to about 8, and the specific gravity at 60° F. is from about 1.006 to about 1.027. The viscosity of bituminous petroleum found in tar sand deposits in the Alberta region is in the range of several million centipoise at formation temperature, which is usually about 40° F.

Although some petroleum has been obtained from tar sand deposits by strip mining, this is possible only in relatively shallow deposits and over 90% of the known tar sand deposits are considered to be too deep for strip mining at the present time. In situ separation of the bituminous petroleum by a process applicable to deep subterranean formation through wells completed therein must be developed if significant amounts of the bituminous petroleum are to be recovered from the deposits which are too deep for strip mining purposes. The methods proposed in the literature to date include steam injection, in situ combustion, solvent flooding processes and steam-emulsification drive process.

Canadian Pat. No. 1,004,593 describes a promising oil recovery method once proposed for use in recovering viscous petroleum from the Peace River Oil Sand Deposits in Alberta, Canada, described in the July 3, 1974

Edition of the Daily Oil Bulletin. It comprises a steam injection-pressurization program wherein steam is injected for long periods of time while maintaining little or no production, sufficient to build the steam pressure in the formation to a value as high as 800 to 1100 pounds per square inch, followed by a prolonged soak period to effect maximum utilization of the thermal energy injected into the formation in the form of steam sufficient to reduce the viscosity of substantially all of the oil in the formation to a very low level, such that it will flow readily. Production is then initiated after the injection and soak cycle had been completed, and it is anticipated that several years will be required for completion of each injection period and soak cycle.

U.S. Pat. No. 3,155,160 describes a single well, push-pull steam only injection process employing alternating pressurization and production cycles to maintain pressure in the ever expanding cavity created adjacent the well by oil recovery.

Despite many proposed methods for recovering viscous petroleum from subterranean viscous petroleum-containing formations including the deep tar sand deposits, there has still been no commercially successful exploitation of deep deposits by in situ separation means up to the present time. In view of the fact there are enormous reserves in the form of viscous petroleum-containing deposits, (estimates of the Athabasca Tar Sand Deposits range upward to 700 billion barrel of petroleum) there is a substantial, unsatisfied need for an efficient, economical method for recovering viscous, bituminous petroleum from deep tar sand deposits.

SUMMARY OF THE INVENTION

I have discovered that viscous petroleum such as the highly viscous, bituminous petroleum found in tar sand deposits may be recovered therefrom in an efficient manner by a process employing steam and a light hydrocarbon, e.g., a $C_3$ to $C_{12}$ aliphatic hydrocarbon material and steam, the process employing a specific program of formation pressurization and rapid drawdown cycles, and it is preferable that these cycles are initiated early in the life of the steam hydrocarbon program. The steam and hydrocarbon are preferably injected into a formation containing adequate communication between at least one injection well and at least one spaced apart production well, or a process should be applied to the formation first which insures the establishment of such a communication path, before the steam-hydrocarbon pressurization and early drawdown process of my invention is begun. Once the existence of the communication path is assured, the process, which comprises repetitive cycles, may be applied to the formation. Each cycle comprises three steps or parts. The first step involves heating the communication path by injecting steam or a mixture of steam and hydrocarbons into the communication path and producing fluids without throttling or restricting flow thereof, so long as no vapor phase or live steam is produced. Once live steam production occurs at the production well, or when the temperature of fluids in the formation adjacent to the production well approaches the temperature of saturated steam at the pressure in the formation immediately adjacent to the production well, the first, preheat phase of the cycle is completed. Next, a mixture of steam and from about 2% to 10% by weight of a light hydrocarbon, e.g. $C_3$ to $C_{12}$ aliphatic hydrocarbon is injected into the injection well at a pressure less than the pressure which will cause fracturing of the overburden above the tar sand deposit. During this second part of the cycle, production of fluids from the production wells is restricted to a rate less than 50% and preferably less than 20 percent of the injection rate to cause the pressure in the vicinity of the production well to rise and be maintained above the vapor pressure of steam and preferably above the vapor pressure of hydrocarbons, thereby ensuring that only liquids are produced at the production well. Pressure at the production well is preferably monitored and the first cycle is continued until the pressure adjacent at the production well is in the range of from about 60 to about 95% of the pressure at which steam and hydrocarbons are being injected into the injection well. When the pressure at the production well reaches a value of at least 60% and preferably at least 80% of the pressure at which steam and hydrocarbons are being injected into the injection well and the temperature levels of produced fluids are near the saturation temperature of steam at that pressure, at which point some vapor phase steam will begin to be produced at the injection well, the second part of the cycle is terminated. The third cycle involves reducing the injection pressure to a value which will cause the flow rate of steam and hydrocarbon into the formation via the injection well to be reduced to a value less than 50% and preferably less than 20% of the original injection flow rate. At the same time, the production well is opened and fluids are allowed to flow therefrom at the maximum safe level, choking production rate only as is necessary to protect production equipment. The third production step in the cycle is continued so long as fluids flow from the production well at a relatively high volume rate. After the flow of fluids has dropped to a value less than 50% and preferably less than 20% of the flow rate at the beginning of the third cycle, the third cycle is terminated and another three step cycle essentially identical to the first cycle is initiated. The first, preheat step in the second and subsequent cycles will usually require much less time than in the first cycle because of the residual heat. This sequence is continued throughout the remaining life of the flood until the desired oil recovery has been attained.

BRIEF DESCRIPTION OF THE DRAWING

The attached FIGURE illustrates the oil recovery versus steam pore volumes for six runs involving steam, steam-propane and steam-pentane, in straight through runs and in runs employing early application of pressurization-drawdown cycles.

DETAILED DESCRIPTION OF THE PREFERRED EMBODIMENTS

The process of my invention is best applied to a subterranean, viscous oil-containing formation such as a tar sand deposit in which there exists an adequate natural permeability to steam and other fluids, or in which a suitable communication path or zone of high fluid transmissability is formed prior to the application of the main portion of the process of my invention. My process may be applied to a formation with as little as two spaced apart wells both of which are in fluid communication with the formation, and one of which is completed as an injection well and one of which is completed as a production well. Ordinarily optimum results are attained with the use of more than two wells, and it is usually perferable to arrange the wells in some pattern as is well known in the art of oil recovery, such as a five spot pattern in which an injection well is surrounded with four production wells, or in a line drive arrangement in which a series of aligned injection wells and a series of aligned production wells are utilized, for the purpose of improving horizontal sweep efficiency.

If it is determined that the formation possesses sufficient initial or naturally occurring permeability that steam and other fluids may be injected into the formation at a satisfactory rate and pass therethrough to spaced apart wells without danger of causing plugging or other fluid flow-obstructing phenomena occuring, the process to be described more fully hereinafter below may be applied without any prior treatment of the formation. Generally, the permeability of viscous formations is not sufficient to allow direct application of the process of my invention, and particularly in the case of tar sand deposits it will ordinarily be necessary first to apply some process for the purpose of gradually increasing the permeability of all or some portion of the formation such that well-to-well communication is established. Many such methods are described in the literature, and include fracturing with subsequent treatment to expand the fractures to form a well-to-well communication zone such as by injecting aqueous emulsifing fluids or solvents into one or both of the wells to enter the fracture zones in a repetitive fashion until adequate communication between wells is established. In some instances it is sufficient to inject a non-condensible gas such as air, nitrogen or a gaseous hydrocarbon such as methane into one well and produce fluids from the remotely located well until mobile liquids present in the formation have been displaced and a gas swept zone is formed, after which steam may be injected safely into the previously gas swept zone without danger of plugging the formation. Plugging is thought to occur in the instances of steam injection because viscous petroleum mobilized by the injected steam forms an oil bank, moves away from the steam bank into colder portions of the formations, thereafter cooling and becoming immobile at a point remote from the place in the formation in which steam is being injected, thus preventing further fluid flow through the plugged portion of the formation. Unfortunately, once the bank of immobile bitumen has cooled sufficiently to become immobile, subsequent treatment is precluded since steam or other fluids which would be capable of mobilizing the bitumen cannot be injected through the plugged portion of the formation to contact the occluding materials, and so that portion of the formation may not be subjected to further oil recovery operations. Accordingly, the step of developing well-to-well communications is an exceedingly important one in this or any other process involving injection of heated fluids such as steam into flow permeability tar sand deposits.

To the extent the horizontal position of the communication channel can be controlled, such as in the instance of expanding a fractured zone into the communication path between spaced apart wells, it is preferable that the communication path be located in the lower portion of the formation, preferably at the bottom thereof. This is desired since the heated fluid will have the effect of mobilizing viscous petroleum in the portion of the formation immediately above the communication path, which will drain downward to the heated, high permeability communication path where the viscous petroleum is easily displaced toward the petroleum well. It has been found to be easier to strip viscous petroleum from a portion of a formation located above the communication path than to strip viscous petroleum from the portion of the formation located below the communication path.

Once the communication path is established, it is preferable that the temperature be raised to a value above the vapor pressure of the solvent to be utilized in the process to be described more fully hereinafter below. This may be conveniently accomplished by injection of steam into the communication path. It frequently occurs that the process utilized to create the communication path will also have the effect of heating the sand or other formation minerals in the path to the desired temperature range, particularly where steam injection is utilized in the communication path formulation stage. Also, the critically of the step of preheating the communication path decreases as the permeability of the path increases, since there is less likelihood of plugging in very high permeability communication paths.

The process of my invention comprises a series of cycles, each cycle consisting of three parts. The first step in the cycle is a heating step which is conveniently accomplished by injecting steam or a mixture of steam and hydrocarbons into the communication path via the injection well and producing fluid from the communication path via the production well. The production of fluids is not throttled or restricted during this first step, so long as no live or vapor phase steam is produced. The first step may also be controlled by monitoring the temperature and pressure in the formation immediately adjacent to the production well, and continuing unrestricted flow of fluids from the production well so long as the formation temperature remains below the saturation temperature of steam at the pressure in the formation adjacent the production well. Once live steam production begins or the temperature in the formation approaches or exceeds steam saturation temperature at the pressure in the formation adjacent to the production, the first step is concluded. In the second part of the cycle, the mixture of steam and the light hydrocarbon is injected into the injection well or wells and fluid production being taken from the remotely located well or wells is restricted or throttled significantly, as will be described more fully below.

The hydrocarbon to be mixed with steam may be any aliphatic hydrocarbon in the $C_3$-$C_{12}$ range, including mixtures thereof, including propane, butane, pentane, hexane, heptane, octane, nonane, decane, undecane and dodecane. The higher molecular weight hydrocarbons within this range are generally more effective than the lower molecular weight hydrocarbons. Saturated hydrocarbons, including paraffinic hydrocarbons are excellent for this purpose. Commercially available mixtures such as natural gasoline, naphtha, kerosene, etc. are also preferred solvents. Commercially available mixtures containing aromatic fractions are also suitable for use in the process of my invention.

The operable concentration range of light hydrocarbon in the hydrocarbon-steam mixture is from about 2 to about 40% by weight and it is preferred that the concentration be in the range of from about 5% to about 20% by weight.

Either saturated or superheated steam may be used in combination with hydrocarbons. The preferred steam quality is from 75% to about 95%.

The pressure at which the mixture of steam and hydrocarbons are injected into the formation is generally determined by the pressure at which fracture of the overburden above the formation would occur since the injection pressure must be maintained below the overburden fracture pressure. Alternately, the maximum pressure generation capability of the steam generation equipment available for the oil recovery operation if less than the fracture pressure, may set the maximum injection pressure. It is desirable that the steam and hydrocarbon be injected at the maximum flow rate possible and at the maximum safe pressure consistent with the foregoing limitations. The actual rate of fluid injection is determined by injection pressure and formation permeability and the steam and hydrocarbon mixture is injected at the maximum attainable rate at the maximum safe pressure. The injection rate should be measured.

The optimum degree to which the flow of fluids from production wells is restricted or throttled can be assertained in a number of ways. It is sometimes sufficient to reduce the flow rate to attain the maximum fluid production that can be accomplished without production of any vapor-phase steam. Ideally the pressure in or adjacent to the production well should be monitored, and the flow of fluids from the production well should be restricted to less than 20 percent of the injection rate. This maintains fluid flow through the channel and still causes the pressure in the flow channel to increase. This procedure is continued until the pressure in the formation adjacent the production well rises to a value from 70 to 95% and preferably at least 80% of the pressure at which the mixture of steam and hydrocarbons are being injected into the injection well. For example, if the steam and hydrocarbon injection pressure is 400 pounds per square inch, the fluid flow rate at the production well should be throttled as described above until the pressure in the formation adjacent the production well has risen to a value of at least 240 pounds per square inch and preferably at least 320 pounds per square inch (60 to 80% of the injection pressure). Ordinarily the pressure will increase gradually as the formation pressure is increased due to the unrestricted steam and hydrocarbon injection and severely restricted fluid flow from the production well; therefore only near the end of the second part of the cycle will be pressure at the production well approach the levels discussed above.

Another method of determining when the second part of the cycle should be terminated involves measuring the temperature of the fluids being produced from the production well, and ending the second part of the cycle when the produced fluid temperature approaches the saturation temperature of steam at the pressure in the formation adjacent the production well. This can be detected at the end of the second part of the cycle by the production of a small amount of vapor phase steam or live steam from the production well.

When the third part of the cycle is initiated, both injection and production procedures are changed dramatically. The restriction to fluid flow from the production well is removed and the maximum safe fluid flow rate is desired from the production wells. That is to say, the fluid flow from the production well should be choked only if and to the degree required to protect the production equipment and for safe operating practices. At the same time, the injection rate of steam and hydrocarbon is reduced to a very low level, principally to prevent back flow of fluids from the formation into the injection well. Ordinarily the injection rate is reduced to a value less than 50% and preferably less than 20% of the original fluid injection rate. This insures that there will be a positive pressure gradient from the injection well to the production well at all times, but permits the maximum effective use of the highly beneficial drawdown portion of the cycle.

The third phase, drawdown portion of the cycle is maintained so long as fluid continues to flow or can be pumped or lifted from the production well at a reasonable rate. Once the fluid flow rate has dropped to a value less than 50 percent and preferably less than 20 percent of the initial fluid flow rate of the production wells, the drawdown cycle may be terminated and a second three part steam-hydrocarbon injection cycle started which is essentially similar to that described above. The first part of the second and subsequent cycles will ordinarily require much less time to complete than in the first cycle because of the residual heat effect.

The oil recovery process is continued with repetitive cycles comprising heating, pressurization with throttled production followed by drawdown cycles with greatly reduced injection rates until the oil recovery efficiency begins to drop off as is detected by a reduction in the oil/water ratio of produced fluids.

EXPERIMENTAL SECTION

For the purpose of demonstrating the operability and optimum operating conditions of the process of my invention, the following experimental results are presented. All of the runs to be described more fully hereinafter below were performed in a three-dimensional simulator cell which is a section of steel pipe, 18 inches in diameter and 15 inches long. One inch diameter wells were included in the cell, one for fluid injection and one for fluid production, each well being positioned 3 inches from the cell wall and 180 degrees apart. The top of the cell was equipped with a piston and sealing ring by means of which hydraulic pressure can be imposed on the tar sand material packed into the cells to simulate overburden pressure as would be encountered in an actual formation.

The cell in each run was packed with tar sand material obtained from a mining operation in the Athabasca Region of Alberta, Canada. A clean sand path, approximately ⅛ inch thick and 2 inches wide was formed between the wells to serve as a communication path. The tar sand material was packed tightly into the cell and then further compressed by means of hydraulic pressure applied by the piston on top of the cell until the density and permeability of the tar sand material approximated that present in a subterranean tar-sand deposit.

In the first run, steam (without hydrocarbons) of approximately 100 percent quality was injected into the cell and fluids were produced from the cell by means of the production well on a "straight through" basis, i.e., without the repetitive cycles of steam injection-pressurization drawdown cycles as described above. About nine pore volumes of steam were injected and it can be seen that only about 30 percent of the oil was recovered even after injecting nine pore volumes of steam. No pressure drawdowns were employed in run 1.

In the second run, a mixture of steam and an average of 23% pentane was utilized without pressurization-drawdown cycles until after about 7 pore volumes of steam had been injected into the formation. It can be seen that slightly over 40 percent of the oil present in the formation was recovered. Drawdown was then applied and the total recovery was raised to about 60% after numerous pressurization-drawdown cycles were applied and the total pore volumes of steam injected had risen to about 8 pore volumes.

In the third run, a mixture of steam and 26% pentane was injected, initiating the drawdown cycle at the beginning of the cycle, and it can be seen from curve 3 that recovery is significantly better than run 2 for all values of steam volume injected. Thus, it can be seen that about one third more oil is recovered in the run using steam and pentane with pressurization and drawdown cycles initiated early in the program than in a corresponding process using steam and pentane without early pressurization-drawdown cycles, or where the pressurization-drawdown cycles are not started until late in the run such as in run 2 where drawdowns were initiated after injecting 7 pore volumes of steam.

Run 4 involved injecting a mixture of steam and 20% propane with no drawdown cycles being used until after about 7 pore volumes of steam had been injected. It can be seen that 60% of the oil was recovered at that point. Drawdowns were initiated after 7 pore volumes of steam injection, but this had little effect on total oil recovery, as contrasted to run 2 using steam and pentane, where late drawdowns improved oil recovery significantly.

Run 5 involved the use of a similar mixture of steam and 14% propane with pressurization and drawdown cycles being initiated at the very beginning of the run. It can be seen that the recovery for run 5 at corresponding values of steam volumes injected is consistently better than run 4 using steam and propane but without early drawdown cycles.

Run 6 utilized a mixture of steam and 9% unifiner naphtha with early pressurization and drawdowns. After 5.6 pore volumes of steam, 71.3% bitumen was recovered.

While run 4 using steam and propane without early drawdowns was superior to run 2 using steam and pentane also without early drawdowns, the reverse is seen to be true in comparing runs 3 and 5, where steam and pentane with drawdowns was superior to steam and propane with drawdowns. This latter pattern has been observed consistently in a number of runs using steam and hydrocarbon with early drawdown cycles. The oil recovery efficiently increases with the average molecular weight of the light hydrocarbon utilized in combination with the steam, up to about $C_{12}$. Natural gasoline is superior to propane, and naphtha is superior to natural gasoline, etc. These observations are all based on runs performed using tar sand materials, and so the especially preferred solvents for recovering bitumen from tar sands and other viscous oil formations by the process of my invention are those in the upper portion of the specified range of aliphatic and other saturated hydrocarbons which are generally normally liquid hydrocarbons.

In an especially preferred embodiment, the hydrocarbon is selected so its boiling temperature at the pressure in the formation during injection is intermediate between the formation temperature and the temperature to which the communication path has been heated.

The foregoing experimental results amply demonstrate that the use of light hydrocarbon and steam injection in the described sequences of repetitive cycles of steam and hydrocarbon injection-pressurization with restricted fluid production followed by reduced fluid injection and essentially unrestricted fluid production from the production well results in substantially improved oil recovery efficiency as compared to use of steam and the same light hydrocarbon materials without the early pressurization and drawdown cycles. More-over, I have discovered that the maximum benefit is obtained if the drawdown cycles are initiated at the earliest possible time after the initiation of injecting steam and hydrocarbon into the formation. Specifically the first drawdown should be initiated by the time the first 4 and preferably before the first 2 pore volumes of steam have been initiated. Finally, the optimum results are obtained using the higher molecular weight hydrocarbons within the specified $C_3$ to $C_{12}$ aliphatic hydrocarbon range, specifically normally liquid hydrocarbons such as naphtha and natural gasoline fractions.

The reasons for the significant improvement noted above are not totally understood. It is believed that the heating and pressurization process followed by pressure reduction accomplishes vaporization of certain fluid components of the formation, which may include water films on the formation sand grains as well as lower molecular weight hydrocarbons, including those injected with the steam as well as hydrocarbons which are naturally occurring in the formation. Vaporization of these materials results in a volume increase which provides the displacement energy necessary to force heated and/or diluted viscous petroleum from the portion of the formation above or below the communication path, into the communication path and subsequently through the communication path toward the production well where they may be recovered to the surface of the earth. It is also believed that the employment of the drawdown cycles, particularly when initiated early in the steam and hydrocarbon injection program, accomplish a periodic cleanout of the communication path whose transmissibility must be maintained if continued oil production is to be accomplished in any thermal oil recovery method. It is not necessarily represented hereby, however, that these are the only or even the principal mechanisms operating during the employment of the process of my invention, and other mechanisms may be operative in the practice thereof which are responsible for a significant portion or even the major portion of the benefits resulting from application of this process.

FIELD EXAMPLE

The following field example is supplied for the purpose of additional disclosure and particularly illustrating a preferred embodiment of the application of the process of my invention, but it is not intended to be in any way limitative or restrictive of the process described herein.

The tar sand deposit is located under an overburden thickness of 500 feet, and the tar sand deposit is 85 feet thick. Two wells are drilled through the overburden and through the bottom of the tar sand deposit, the wells being spaced 80 feet apart. Both wells are completed in the bottom 5-foot section of the tar sand deposit and a gravel pack is formulated around the slotted liner on the end of the production tubing in the production well, while only a slotted liner on the end of tubing is used on the injection well.

The output of an air compressor is connected to the injection well and air is injected thereinto at an initial rate of about 250 standard cubic feet per hour, and this rate is maintained until evidence of air production is obtained from the production well. The air injection rate is thereafter increased gradually until after about eight days, the air injection rate of 1,000 standard cubic feet of air per hour is attained, and this air injection rate is maintained constant for 48 hours to ensure the establishment of an adequate air-swept zone in the formation.

In the first phase of the first cycle of the process of my invention, eighty-five percent quality steam is injected into the injection well to pass through the air-swept zone, for the purpose of further increasing the permeability of the zone and heating the communication path between the injection well and production well. The injection pressure is initially 350 pounds per square inch, and this pressure is increased over the next 5 days to about 475 pounds per square inch, and maintained constant at this rate for 2 weeks. Bitumen is recovered from the production well, together with steam condensate. All of the liquids are removed to the surface of the earth, it being desired to maintain steam flow through the formation on a throughput, unthrottled basis in the initial stage of the process for the purpose of establishing a heated, stable communication path between the injection well and production well. The steam serves to heat and mobilize bitumen in the previously air-swept zones, and the mobilized bitumen is displaced toward the production well and then transported to the surface of the earth. Removal of bitumen from the air-swept portion of the formation reduces the bituminous petroleum saturation therein and therefore increases the permeability of a zone of the formation of the lower portion thereof and extending essentially continually between the injection well and the production well. In addition, the communication zone is heated by passing steam therethrough which is desirable preliminary step to the application of the subsequently described process of my invention.

After approximately two months of steam injection without any form of fluid flow restraint, it is determined that an adequately stable, heated communication path has been established, and live steam is being produced.

A commercially available naphtha is selected as the light hydrocarbon to be utilized in combination with steam in the second part of the cycle of the process of my invention, and is comingled with steam in the concentration of approximately 6.5 percent by weight. This mixture of steam and naphtha is injected into the injection well at an injection pressure of 500 pounds per square inch. Flow of fluids from the production well is restricted by use of a 3/16 inch choke which ensures that the flow rate of fluids from the formation is less than about 40 barrels per day. This is less than 10 percent of the volume flow rate of steam and hydrocarbon into the injection well, which is 450 barrels per day. Pressure at the production well rises gradually over a four month period until it approaches 400 pounds per square inch, and a minor amount of live steam is being produced at the production well, which verifies that the end of the second phase of the first cycle of the process of my invention has been reached.

In order to accomplish the third part of the pressurization-depletion cycle of the process of my invention, the steam and hydrocarbon injection pressure is reduced to about 300 pounds per square inch, which effectively reduces the flow rate of steam and hydrocarbon into the injection well to about 40 barrels per day, less than 10 percent of the original volume injection rate. At the same time, the choke is removed from the production well and fluid flow therefrom is permitted without any restriction at all. The fluid being produced from the production well is a mixture of essentially "free" bitumen, comprising bitumen with only a minor portion of water emulsified therein, and an oil-in-water emulsion. The oil-in-water emulsion represents approximately 80 percent of the total fluid recovered from the well, and the free bitumen is easily separated from the oil-in-water emulsion. The oil-in-water emulsion is then treated with chemicals to resolve it into a relatively waterfree bituminous petroleum phase and water. The water is then treated and recycled into the steam generator.

Production of fluids under these conditions is continued until the flow rate diminishes to a value of about 15 percent of the original flow rate at the start of this depletion cycle, which indicates that the maximum drawdown effect has been accomplished. This requires approximately 120 days. Another steam-heating step followed by steam hydrocarbon injection cycle with production being curtailed by means of the choke as is described above is then initiated, and the production then continues through a plurality of cycles of heating, injection with restricted production followed by greatly reduced steam and hydrocarbon injection and virtually unrestricted fluid production from the production well. As consequence of application of the process of this invention, no problems associated with bituminous petroleum blockages is encountered and it is calculated that approximately 85 percent of the bituminous petroleum present in the portion of the formation swept by fluids injected into the injection well and its pilot are recovered from the formation.

Thus I have disclosed and demonstrated how the oil recovery efficiency of a steam and hydrocarbon process may be dramatically improved by utilization of series of cycles, comprising a first phase comprising heating with unrestricted production followed by injecting steam and hydrocarbon at a high rate into the formation with fluid flow being restricted susbstantially, followed by virtually unrestricted fluid flow from the production well and substantially reduced steam and hydrocarbon fluid injection, for purposes of drawdown of formation pressure. While my invention has been described in terms of a number of specific illustrative embodiments, it should be understood that it is not so limited since numerous variations thereover will be apparent to persons skilled in the art of oil recovery from viscous oil formations without departing from the true spirit and scope of my invention. It is my invention and desire that my invention be limited only by those restrictions or limitations as are contained in the claims appended immediately hereinafter below.

I claim:

1. A method for recovering viscous petroleum from a subterranean, viscous petroleum-containing, permeable formation including a tar sand deposit, said formation being penetrated by at least one injection well and by at least one production well, comprising:

(a) injecting a heating fluid comprising steam into the formation via the injection well and recovering liquids from the production well until live steam is produced from the production;

(b) thereafter injecting into the formation via the injection well, a mixture of steam and a hydrocarbon having from 3 to 12 carbon atoms at an injection pressure less than the fracture pressure of the overburden above the viscous petroleum formations, and at a determinable flow rate, while restricting the flow rate of fluids from the production well to a value less than 50 percent of the flow rate of fluids being injected into the injection well;

(c) determining the formation pressure in the vicinity of the production well;

(d) continuing injecting steam and hydrocarbon into the injection well and producing fluids from the production well at a restricted value until the formation pressure adjacent the production well is equal to a value between about 60 and 95 percent of the fluid injection pressure at the injection well;

(e) thereafter increasing the rate of fluid production from the formation via the producing well to the maximum safe value and simultaneously reducing the injection rate of steam and hydrocarbon into the injection well to a value less than 50 percent of the original injection rate at which steam and hydrocarbons were injected into the injection well; and (f) continuing production of fluids from the production well at a high rate and injection steam and hydrocarbon into the injection well at a reduced rate until the flow rate of fluids from the production well drops to a value below 50 percent of the initial fluid flow rate of step (e).

2. A method as recited as claim 1 wherein the concentration of hydrocarbon in the steam-hydrocarbon mixture is from 2 to 40% by weight.

3. A method as recited in claim 1 wherein the concentration of hydrocarbon is from 5 to 20% by weight.

4. A method as recited in claim 1 wherein the steam is saturated or superheated.

5. A method as recited in claim 1 wherein the hydrocarbon is selected from the group consisting of propane, butane, pentane, hexane, heptane, octane, nonane, decane, undecane, dodecane, natural gasoline, naphtha, kerosene and mixtures thereof.

6. A method as recited in claim 1 wherein the flow of fluids from the production well is restricted to maintain the fluid flow rate from the production well at a value less than 20% of the rate at which steam and hydrocarbons are being injected into the injection well.

7. A method as recited in claim 1 wherein steps (a) through (f) are repeated for a plurality of cycles.

8. A method for recovering viscous petroleum from a sbuterranean, viscous petroleum-containing, permeable formation, including a tar sand deposit, said formation being penetrated by at least one injection well and by at least one production well, comprising:

(a) forming a high permeability fluid communication path in the formation extending essentially continually between the injection well and the production well;

(b) injecting a heating fluid into the communication path to raise the temperature thereof to a predetermined value;

(c) injecting into the heated communication path a mixture of steam and hydrocarbon having from 3 to 12 carbom atoms via the injection well at an injection pressure less than the fracture pressure of the overburden above the viscous petroleum formations, and at a determinable flow rate;

(d) restricting the flow rate of fluids from the production well to a value less than 50 percent of the flow rate of fluids being injected into the injection well;

(e) determining formation pressure in the vicinity of the production well;

(f) continuing injecting steam and hydrocarbon into the injection well and producing fluids from the production well at a restricted value until the formation pressure adjacent the production well is from 60 to 95 percent of the fluid injection pressure at the injection well;

(g) thereafter increasing the fluid production to the maximum safe value and simultaneously reducing the injection rate of steam and hydrocarbon into the injection well to a value less than 50 percent of the original injection rate at which steam and hydrocarbons were injected into the injection well; and (h) continuing production of fluids from the production well at a high rate and injection steam and hydrocarbon into the injection well at a reduced rate until the flow rate of fluids from the production well drops to a value below 50 percent of the initial fluid flow rate of step (g).

9. A method as recited in claim 8 wherein the concentration of hydrocarbon in the steam-hydrocarbon mixture is from 2 to 40% by weight.

10. A method as recited in claim 8 wherein the concentration of hydrocarbon is from 5 to 20% by weight.

11. A method as recited in claim 8 wherein the steam is saturated or superheated.

12. A method as recited in claim 8 wherein the hydrocarbon is selected from the group consisting of propane, butane, pentane, hexane, heptane, octane, nonane, decane, undecane, dodecane, natural gasoline, naphtha, kerosene and mixtures thereof.

13. A method as recited in claim 8 wherein the flow of fluids from the production well is restricted to maintain the fluid flow rate from the production well at a value less than 20% of the rate at which steam and hydrocarbons are being injected into the injection well.

14. A method of recovering viscous petroleum from a subterranean, permeable, viscous petroleum-containing formation penetrated by at least one injection well and by at least one production well, both wells being in fluid communication with the formation, comprising (a) fracturing the formation adjacent each of the wells, said fractures being in the lower portion of the formation and extending at least part of the distance between the wells;

(b) injecting a viscous petroleum mobilizing fluid into the fracture zone adjacent at least one of said wells and recovering said fluid and petroleum from said fracture;

(c) repeating step (b) to form a high permeability communication path between said wells;

(d) injecting a heating fluid comprising steam into said communication path via one well and recovering fluids from the communication path by the other well until live steam is produced at the other well;

(e) injecting steam and a hydrocarbon whose boiling temperature is intermediate between the formation temperature and the temperature to which the communication path has been heated into the preheated communication path via the injection well at a predetermined pressure less than the fracture pressure of the overburden;

(f) determining the flow rate at which steam and hydrocarbon are being injected into the formation via the injection well;

(g) restricting the flow rate of fluids being produced from the formation via the production well to a value less than 50 percent of the flow rate of fluids being injected into the injection well;

(h) determining formation pressure in the vicinity of the production well;

(i) reducing the injection rate of steam and hydrocarbon into the injection well when the formation pressure adjacent to the production well is from 60 to 90 percent of the injection pressure at the injection well to a value less than 20% of the original injection rate; and simultaneously (j) increasing fluid production rate from the production well to the maximum safe value;

(k) continuing step (j) until the rate of fluid flow from the production well has declined to a value below 50 percent of the value at the beginning of step (j); and (l) repeating steps (c) through (j) for a plurality of cycles.

15. A method of recovering viscous petroleum from a permeable, subterranean, viscous petroleum-containing formation penetrated by an injection means and a production means, comprising:

(a) injecting steam and a $C_3$ to $C_{12}$ hydrocarbon into the formation at a predetermined pressure below the fracture pressure of the overburden via the injection means;

(b) restricting the fluid production rate via the production means sufficiently to ensure production of substantially all liquids with no vapor phase steam;

(c) determining the temperature of fluids being produced from the formation via the production means;

(d) reducing the rate of injecting steam and hydrocarbons into the formation when the temperature of the produced fluids rise to a value equal to the saturation temperature of steam at the injection pressure to a value less than 50% of the original fluid injection rate; and simultaneously;

(e) increasing the rate of fluid flow from the production means to the maximum safe value;

(f) continuing step (e) until the flow rate of fluids from the formation drops to a value below 50% of the original value; and (g) repeating steps (a) through (f) at least once.

16. A method of recovering viscous petroleum from a permeable, subterranean, viscous petroleum-containing formation penetrated by an injection means and a production means, comprising:

(a) injecting steam and a $C_3$ to $C_{12}$ hydrocarbon into the formation at a predetermined pressure below the fracture pressure of the overburden via the injection means;

(b) producing fluids from the formation at a rate below 50 percent of the fluid injection rate;

(c) increasing the rate of fluid production to the maximum safe value when vapor phase steam production from the formation via the production means begins; and simultaneously;

(d) reducing the rate at which steam and hydrocarbons are injected to a value less than 50% of the injection rate of step (a).

* * * * *